US012644445B2

(12) United States Patent
Thompson

(10) Patent No.: US 12,644,445 B2
(45) Date of Patent: Jun. 2, 2026

(54) COMPRESSOR SUSPENSION SYSTEM FOR PORTABLE GAS SOURCE

(71) Applicant: HILL-ROM SERVICES PTE.LTD., Singapore (SG)

(72) Inventor: Loren Thompson, Auburn Hills, MI (US)

(73) Assignee: HILL-ROM SERVICES PTE. LTD., Singapore (SG)

( * ) Notice: Subject to any disclaimer, the term of this patent is extended or adjusted under 35 U.S.C. 154(b) by 1 day.

(21) Appl. No.: 18/968,929

(22) Filed: Dec. 4, 2024

(65) Prior Publication Data

US 2025/0188917 A1 Jun. 12, 2025

Related U.S. Application Data

(60) Provisional application No. 63/607,347, filed on Dec. 7, 2023.

(51) Int. Cl.
*F04B 39/00* (2006.01)

(52) U.S. Cl.
CPC ..... *F04B 39/0044* (2013.01)

(58) Field of Classification Search
CPC ..... F04B 39/0044; F04B 39/0055; F04B 39/0072; F04B 39/123; F04D 29/668; F04D 29/663; A61M 16/0066; A61M 2205/42
USPC ..... 417/363, 312, 360
See application file for complete search history.

(56) References Cited

U.S. PATENT DOCUMENTS

| | | | | |
|---|---|---|---|---|
| 110,112 | A | 12/1870 | Chase | |
| 2,977,043 | A | 3/1961 | Scheldorf | |
| 4,363,217 | A | 12/1982 | Venuti | |
| 4,793,775 | A * | 12/1988 | Peruzzi | F04B 39/127 417/313 |
| 7,527,053 | B2 | 5/2009 | Devries et al. | |
| 7,753,996 | B1 | 7/2010 | Deane et al. | |
| 10,092,716 | B2 | 10/2018 | Chao et al. | |
| 10,201,675 | B2 | 2/2019 | Moir et al. | |
| 10,400,773 | B2 | 9/2019 | Daly et al. | |
| 10,695,522 | B2 | 6/2020 | Cariola et al. | |

(Continued)

FOREIGN PATENT DOCUMENTS

| | | | |
|---|---|---|---|
| EP | 3482788 | A1 | 5/2019 |
| JP | 2005198690 | A | 7/2005 |

*Primary Examiner* — Benjamin Doyle
(74) *Attorney, Agent, or Firm* — Stetina Garred Brucker & Newboles

(57) ABSTRACT

A portable gas source (PGS) comprising a housing and a compressor disposed within the housing. The compressor includes a first air inlet, a second air inlet, and an air outlet. The PGS further comprises a compressor dampening system including resilient first and second bellows which are each operatively interposed between the compressor and the housing and adapted to dampen movement of the compressor along multiple axes, with the first and second bellows at least partially defining respective ones of the first and second air inlets, and each fluidly communicating with ambient air. The dampening system also includes, among other structures, resilient first and second side bands which are cooperatively engaged to and extend between the compressor and the housing in opposed relation to each other, each of the first and second side bands likewise being adapted to dampen movement of the compressor along multiple axes.

20 Claims, 6 Drawing Sheets

(56) References Cited

U.S. PATENT DOCUMENTS

| | | | | |
|---|---|---|---|---|
| 10,814,083 | B2 | 10/2020 | Cariola et al. | |
| 11,191,913 | B2 | 12/2021 | Kenyon et al. | |
| 11,293,453 | B2 | 4/2022 | Kenyon et al. | |
| 11,666,688 | B2 | 6/2023 | Van Asseldonk et al. | |
| 12,337,108 | B1 * | 6/2025 | Luo | F04D 29/663 |
| 2010/0059055 | A1 * | 3/2010 | Brungart | F04D 29/668 128/204.18 |
| 2013/0263854 | A1 * | 10/2013 | Taylor | A61M 16/0816 128/204.23 |
| 2014/0014109 | A1 * | 1/2014 | Grasmuck | A61M 16/0066 128/204.18 |
| 2018/0193577 | A1 * | 7/2018 | Cariola | A61M 16/161 |
| 2024/0157071 | A1 * | 5/2024 | Moir | A61M 16/021 |

* cited by examiner

COMPRESSOR SUSPENSION SYSTEM FOR PORTABLE GAS SOURCE

CROSS-REFERENCE TO RELATED APPLICATIONS

The present application claims priority to U.S. Provisional Application Ser. No. 63/607,347 filed Dec. 7, 2023, the disclosure of which is incorporated herein by reference.

STATEMENT RE: FEDERALLY SPONSORED RESEARCH/DEVELOPMENT

Not Applicable

BACKGROUND

1. Technical Field of the Invention

The present disclosure relates generally to a portable gas source (PGS) and, more particularly, to a PGS including an integrated compressor which is outfitted with a suspension system adapted to effectively dampen the vibration of the compressor during its operation as effectively reduces the noise generated by the PGS.

2. Description of the Related Art

A wide range of clinical conditions may require some form of ventilation therapy, whereby the patient's work of breathing is assisted by the flow of pressurized gas from a ventilator to the patient's airway. These conditions may include hypoxemia, various forms of respiratory insufficiency, and airway disorders. There are also non-respiratory and non-airway diseases that require ventilation therapy, such as congestive heart failure and neuromuscular diseases.

To improve the quality of life of many patients who require long-term ventilation therapy, ventilation systems have been developed which are miniaturized and portable. Some of these systems, for example, the Life2000® system by Breathe Technologies, Inc., are so lightweight and compact that in their extended range or stand-alone configurations, they are wearable by the patient. These systems make use of a source of pressurized ventilation gas to operate. In the stationary or extended-range configuration, the source of pressurized gas may be a stationary compressor unit, which may be kept in a patient's home. In the stand-alone configuration, which may be generally used when the patient is outside the home, the portable, wearable ventilator generally receives its ventilation gas from a pressurized gas cylinder or a portable compressor.

Many of the above clinical conditions and other clinical conditions may also require or benefit from supplemental oxygen therapy, whereby the gas introduced to the patient's airway is augmented by the presence of additional oxygen such that the patient inspires gas having oxygen levels above atmospheric concentration (20.9% at 0% humidity). Supplemental oxygen therapy involves the patient receiving supplemental oxygen gas from an oxygen gas source, which is typically a compressed or cryogenic oxygen cylinder, or an oxygen gas generator. For many years, patients who wished to be mobile relied on oxygen cylinders. However, in recent years, miniaturization and improvements in battery technology has resulted in the development of portable oxygen concentrators.

Portable oxygen concentrators typically operate by pressure swing adsorption (PSA), in which ambient air is pressurized by a compressor and passed through an adsorbent sieve bed. The sieve bed is typically formed of a zeolite which preferentially adsorbs nitrogen when at high pressure while oxygen passes through. Once the sieve bed reaches its capacity to adsorb nitrogen, the pressure can be reduced. This reduction in pressure causes the adsorbed nitrogen to be desorbed so it can be purged, leaving a regenerated sieve bed that is again ready to adsorb nitrogen. With repeated cycles of this operation, an enriched oxygen gas may be generated. Typically, portable oxygen concentrators have at least two sieve beds so that one may operate while the other is being purged of the nitrogen and vented. Typical portable oxygen concentrators today output an enriched oxygen gas with a purity of around 87-96% oxygen. Among existing oxygen concentrators today which may be considered portable (especially by an individual suffering from a respiratory condition), there are generally two types available. The first type, which is larger and heavier, is usually capable of continuous flow delivery. Models of this type typically weigh between 5-10 kg, have maximum flow rates of around 5-6 liters per minute or less, and are generally configured with wheels and a handle, often mimicking the appearance of a suitcase. The second type are lighter units more suitable for being carried or worn in a satchel, handbag, or a backpack. Models of this type typically weigh less than 2.5 kg and are usually limited to pulsed delivery modes with maximum flow rates of around 2 liters per minute or less.

Portable oxygen concentrators have a substantial cost and convenience advantage over pressurized oxygen cylinders, due to the pressurized oxygen cylinders requiring ongoing refilling or replacement. Additionally, portable oxygen concentrators are considered to be significantly safer than pressurized oxygen cylinders. This safety consideration can have a substantial impact on a patient's quality of life, because many portable oxygen concentrators have been approved by the FAA for use by travelers on commercial airlines, whereas oxygen cylinders are universally banned on commercial flights. Consequently, patients with pressurized oxygen cylinders must make expensive and time-consuming preparations with an airline ahead of time or forego airline travel entirely.

For patients with conditions where assistance with the work of breathing is not required, supplemental oxygen therapy alone, without ventilation therapy, may be sufficient. However, for many patients, combined ventilation therapy and supplemental oxygen therapy may be a more optimal treatment. In healthy patients, sufficient ventilation to perform the work of breathing may typically require minute ventilation rates of between 5 and 8 L/min while stationary, which may double during light exercise, and which may exceed 40 L/min during heavy exercise. Patients suffering from respiratory conditions may require substantially higher rates, and substantially higher instantaneous rates. This is especially true when these patients are outside the home and require portability, as at these times such patients are often also involved in light exercise.

It may thus be seen that patients who would prefer to receive this combined mode of treatment are substantially limited, since in many cases existing portable oxygen concentrators do not output gas at pressures and/or volumes high enough to be used with a wearable, portable ventilator without the presence of an additional source of compressed gas. While existing systems and methods that seek to provide a combined supplemental oxygen/ventilation system have been developed in the prior art, these existing systems suffer from various deficiencies which Applicant has addressed in the system described in its U.S. Pat. No.

11,607,519 entitled O2 CONCENTRATOR WITH SIEVE BED BYPASS AND CONTROL METHOD THEREOF, the disclosure of which is incorporated herein by reference.

Within the system described in U.S. Pat. No. 11,607,519, the oxygen concentrator and compressor elements (among others) are housed in a unit which may be broadly characterized as a PGS. One of the desired attributes of the PGS is the generation of minimal noise arising from its operation and, more particularly, the operation of its compressor. As will be recognized, by virtue of its structural and attendant functional attributes, the compressor normally experiences a substantive level of vibration during its operation. This vibration, if not properly dampened, may give rise to the undesirable production of excessive noise. Complicating the ability to effectively dampen the vibration of the compressor is the limited space availability within the housing of the PGS to accommodate the necessary dampening modalities. The present disclosure provides a unique and effective dampening solution for the compressor of the PGS, such solution including the achievement of spatial economies by having certain structural elements of the PGS provide dual use functionality, one of which is a compressor dampening function. These and other attributes of the present disclosure will be described in more detail below.

BRIEF SUMMARY

The present disclosure contemplates various systems, methods, and apparatuses for overcoming the above drawbacks accompanying the related art. One aspect of the embodiments of the present disclosure is a portable gas source (PGS) comprising a housing having a compressor disposed therein. The compressor includes a first air inlet, a second air inlet, and an air outlet.

The PGS also includes a compressor dampening system comprising resilient first and second bellows which are each operatively interposed between the compressor and the housing. Each of the first and second bellows are adapted, and hence operative, to dampen movement of the compressor along multiple axes. The first and second bellows also each at least partially define respective ones of the first and second air inlets of the compressor, and each further fluidly communicate with ambient air. Thus, each of the first and second bellows has dual-purpose functionality in the context of the dampening system in that in addition to providing vibration dampening functionality to the compressor, they also partially define requisite inlet flow paths thereto. The first and second bellows are each preferably fabricated from a material selected to be of a Shore hardness which is operative to maintain the patency of respective ones of the first and second air inlets partially defined thereby, while concurrently dampening movement of the compressor In addition to the first and second bellows, the compressor dampening system may comprise resilient first and second side bands which are cooperatively engaged to and extend between the compressor and the housing in opposed relation to each other. Like the first and second bellows, each of the first and second side bands is adapted, and hence operative, to dampen movement of the compressor along multiple axes.

The compressor dampening system may further comprise a resilient discharge tube which is operatively coupled to and fluidly communicates with the air outlet of the compressor. Like the first and second bellows and side bands, the discharge tube is adapted, and hence operative, to dampen movement of the compressor along multiple axes. Along these lines, the discharge tube is likewise preferably fabricated from a material selected to be of a Shore hardness which is operative to maintain the patency of an airflow path defined thereby while concurrently dampening movement of the compressor. Like each of the first and second bellows identified above, the discharge tube has dual-purpose functionality in the context of the compressor dampening system in that in addition to providing vibration dampening functionality to the compressor, it also defines a requisite discharge conduit from the compressor to other structural features of the PGS.

Still further, the compressor dampening system may comprise a resilient suspension band which is cooperatively engaged to and extends between the compressor and the housing. Like those other structural features of the compressor dampening system identified above, the suspension band is adapted, and hence operative, to dampen movement of the compressor along multiple axes. In a preferred implementation, the suspension band and the discharge tube are cooperatively engaged to the compressor in generally opposed relation to each other.

The PGS may further comprise a support plate which is disposed within the housing underneath the compressor. The first and second bellows and the first and second side bands are each cooperatively engaged to and extend between the support plate and the compressor, with the first and second bellows each underlying the compressor. Along these lines, in a preferred implementation, each of the first and second side bands is cooperatively engaged to the support plate at each of three separate contact points. In addition to the support plate, the PGS may further comprise a stand which is disposed within the housing, with the support plate being used to operatively interface the compressor to the stand.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The present disclosure encompasses various embodiments of a portable gas source (PGS) including, among other things, an oxygen concentrator, compressor, and compressor dampening system. The detailed description set forth below in connection with the appended drawings is intended as a description of several currently contemplated embodiments and is not intended to represent the only form in which the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Figure 1:
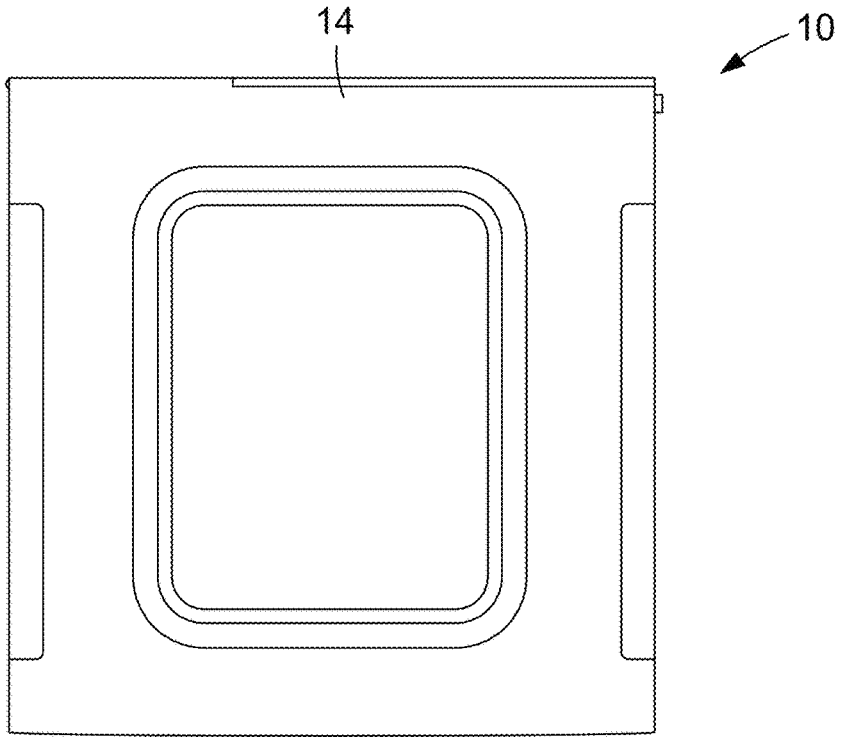
FIG. 1 is a side view of an exemplary PGS into which the compressor dampening system according to an embodiment of the present disclosure is integrated.

Referring now to the drawings, FIG. 1 shows an exemplary portable gas source (PGS) 10 according to an embodiment of the present disclosure. The PGS 10 is designed to be operative to deliver a high oxygen content gas produced by an internal oxygen concentrator working in concert with an internal compressor 12 (shown in FIGS. 3-10). The PGS 10 includes an exterior cover or housing 14 which effectively covers or shields the internal components thereof, including the compressor 12. As indicated above, several structural and functional features of the PGS 10 are described with particularity in U.S. Pat. No. 11,607,519 entitled O2 CONCENTRATOR WITH SIEVE BED BYPASS AND CONTROL METHOD THEREOF which is incorporated herein by reference.

In the description of the PGS 10 which follows, emphasis will be placed on the structural and functional attributes of a compressor dampening system which comprises several of those above-referenced internal components disposed within the housing 14. Along these lines, as will be described in more detail below, the compressor dampening system is designed to dampen the vibration of the compressor 12 which normally occurs during its operation, thereby in turn facilitating an effective reduction in the noise level generated by the PGS 10 during its operation. Considering the over-arching desirability to construct the PGS 10 to be as small and lightweight as possible, the compressor dampening system is uniquely configured to overcome the resulting internal spatial constraints within the housing 14. This achievement of spatial economies entails, among other things, having certain internal components of the PGS 10 which are operatively coupled to the compressor 12 provide dual use functionality, at least one of which is directly related to the vibrational dampening of the compressor 12.

Figure 2:
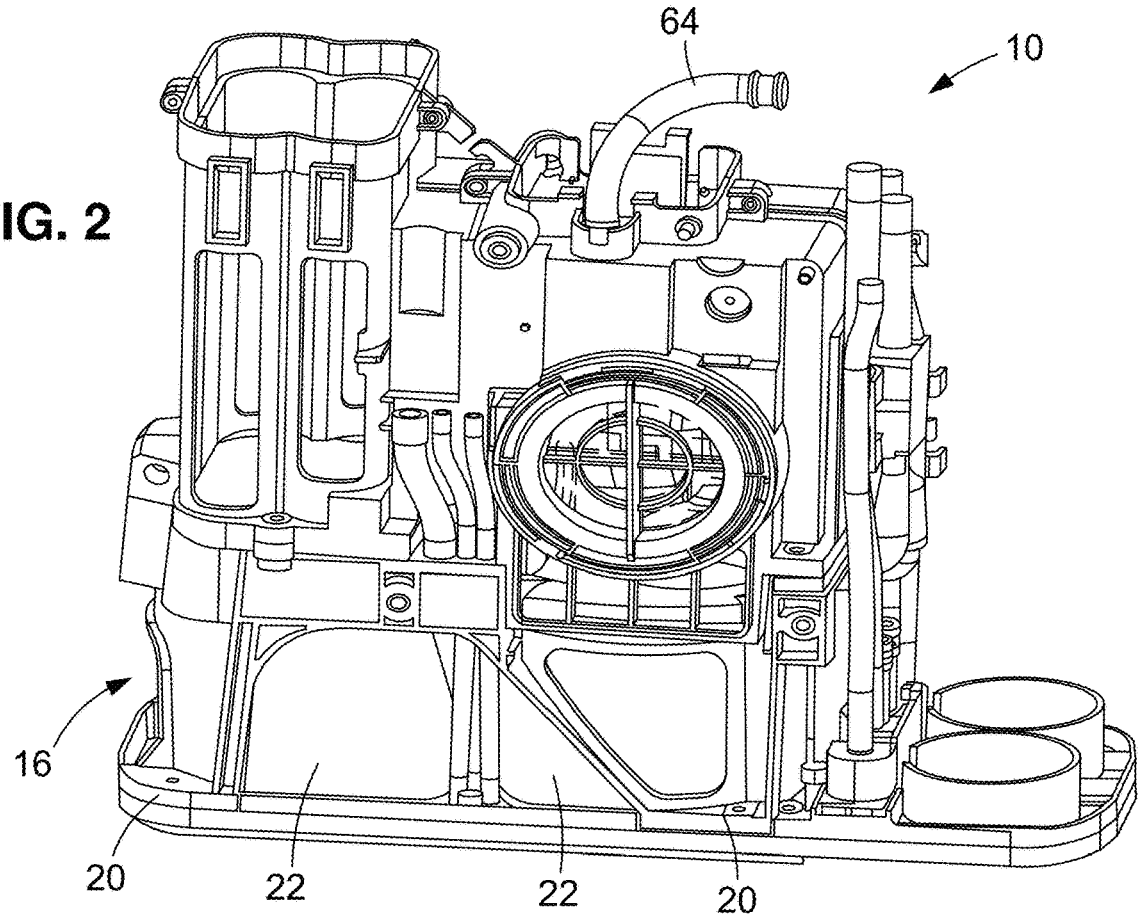
FIG. 2 is a top perspective view of the exemplary PGS with the exterior housing removed for purposes of exposing various internal features of the PGS, including a stand upon which the compressor is positioned.
Figure 3:
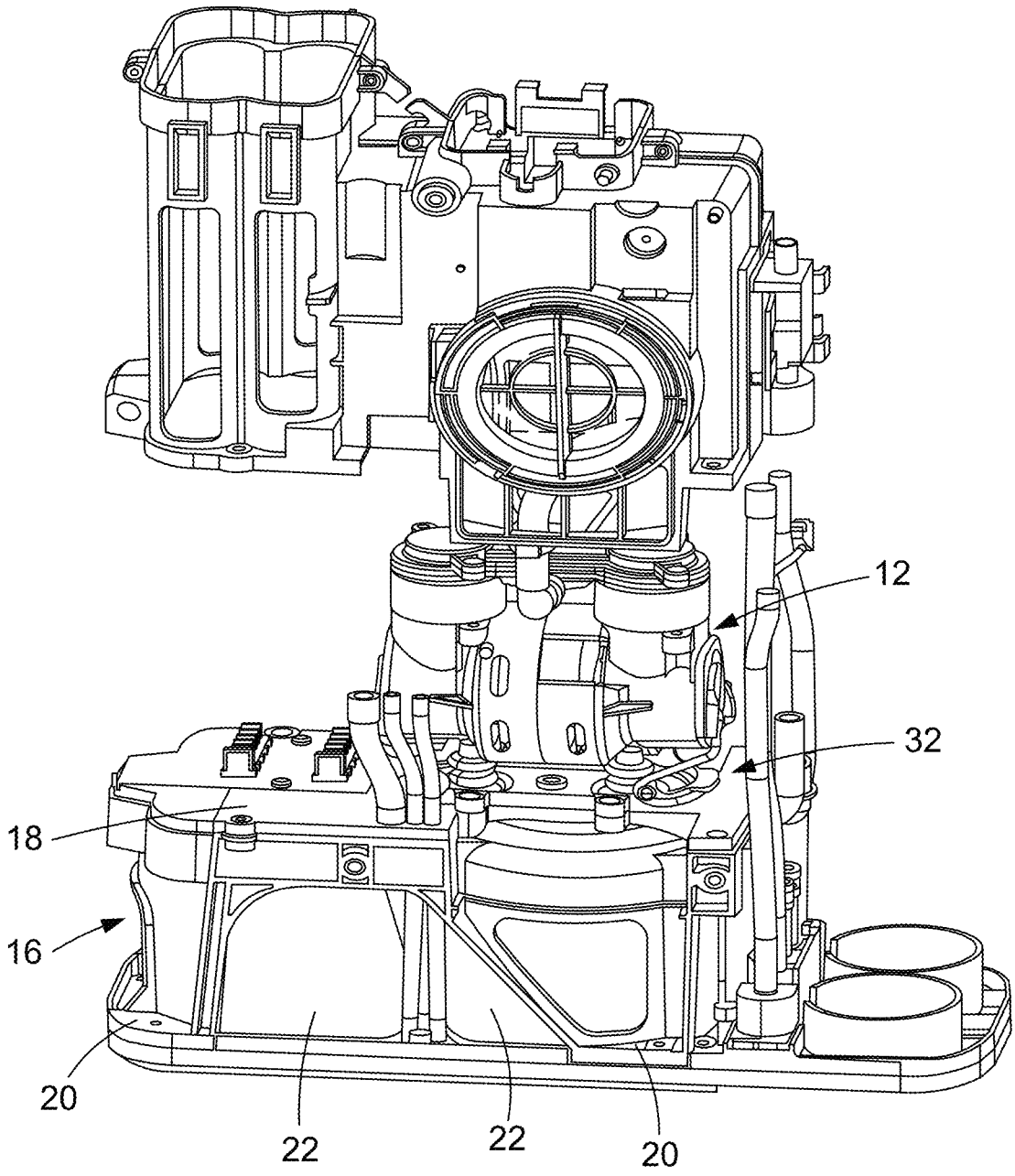
FIG. 3 is like FIG. 2, but with several additional internal features of the PGS partially removed to more clearly depict the stand and compressor positioned thereon.
Figure 4:
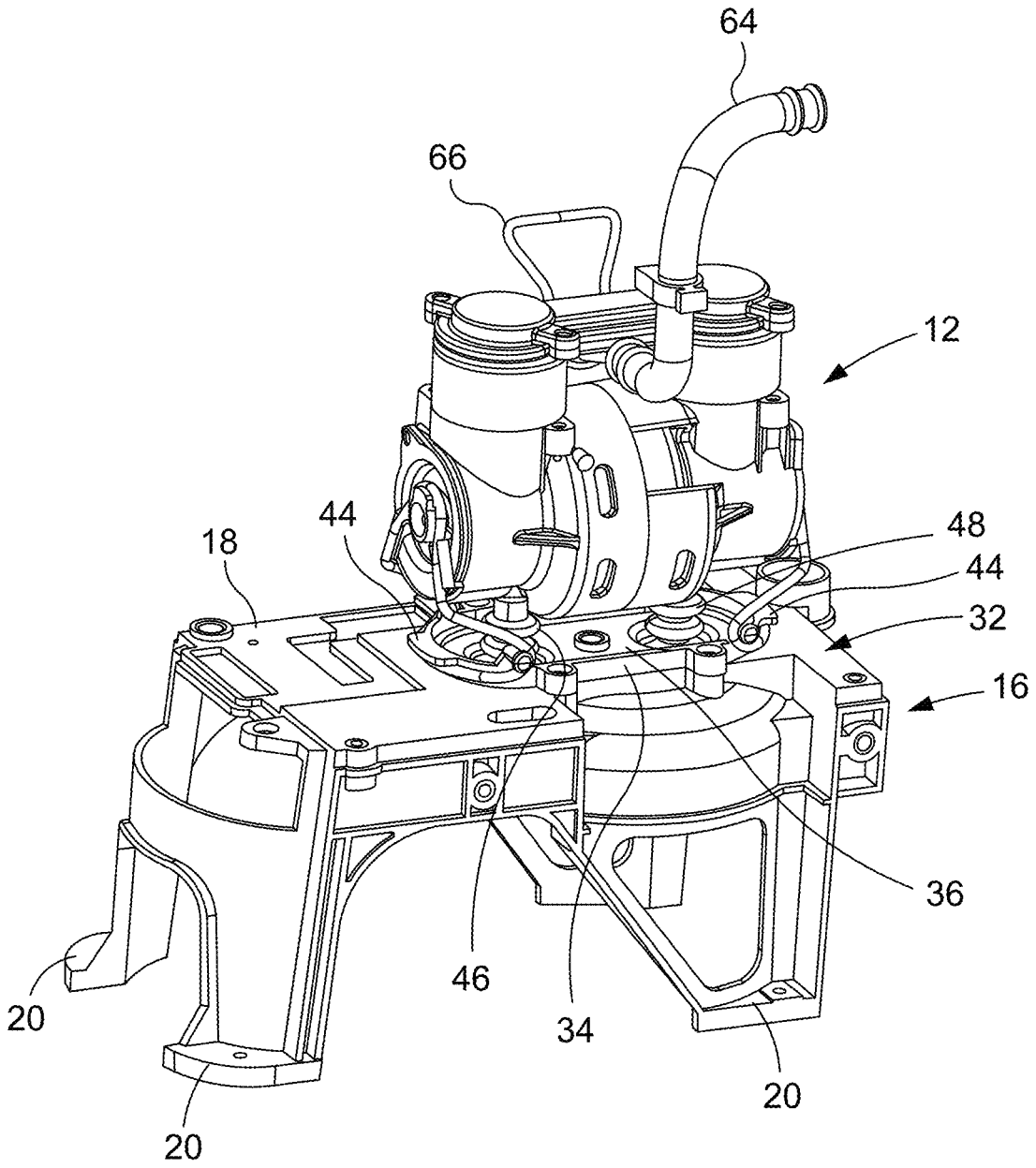
FIG. 4 is a top perspective view of the stand having the compressor positioned thereon and omitting most of the remaining structural features of the PGS.
Figure 5:
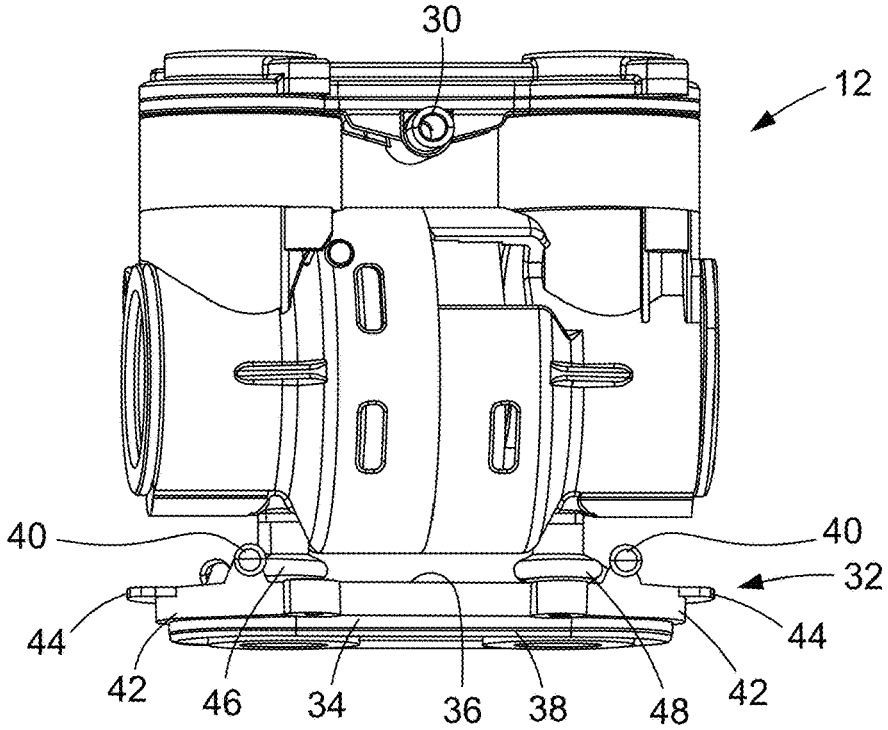
FIG. 5 is a side view of the compressor as cooperatively engaged to a spaced pair of multi-function bellows of the present dampening system, the bellows being part of a support plate assembly used to operatively interface the compressor to the stand.
Figure 6:
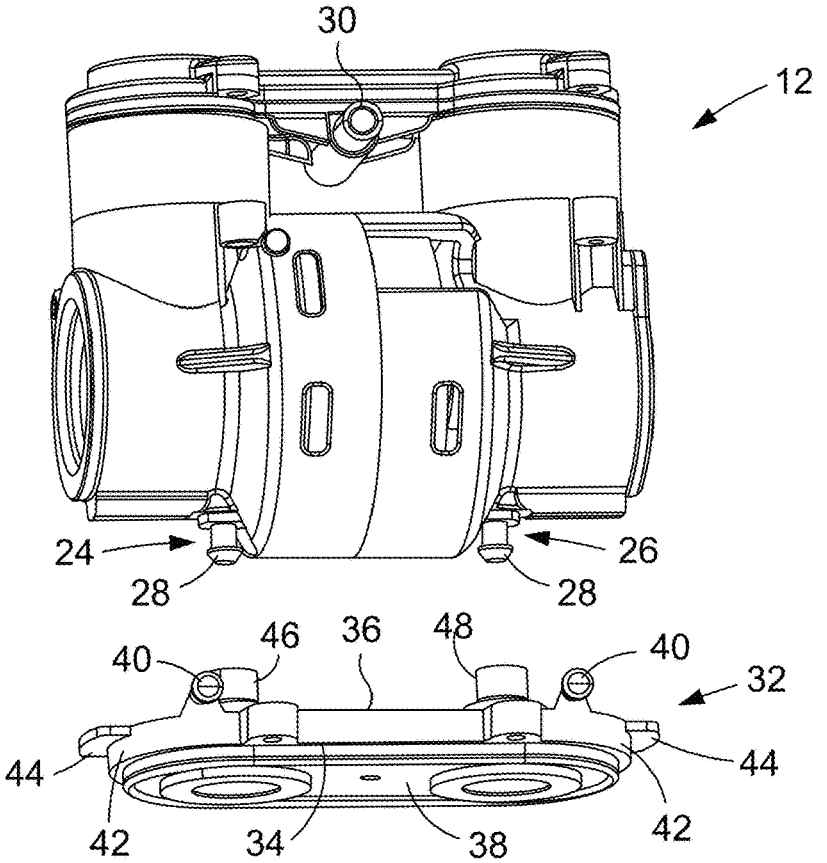
FIG. 6 is an exploded view of the compressor and support plate assembly shown in FIG. 5.
Figure 7:
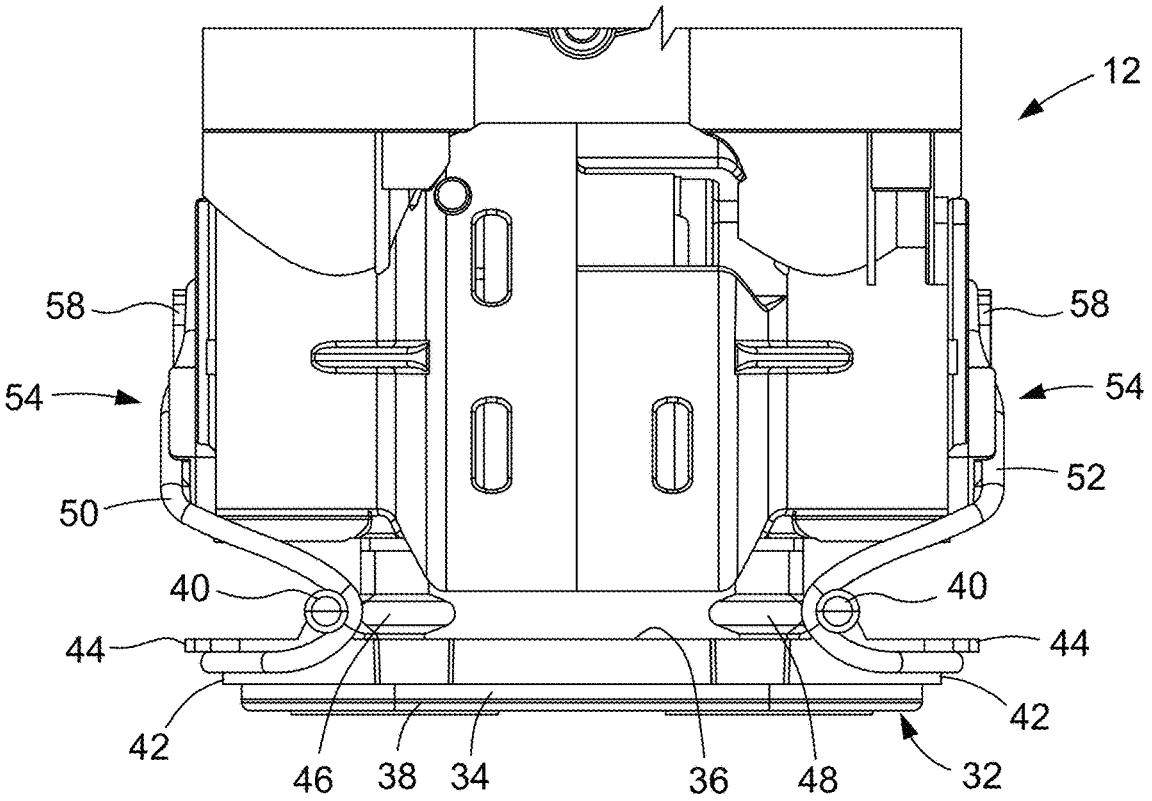
FIG. 7 is a side view like FIG. 5, but further depicting an opposed pair of side bands of the present dampening system.

FIG. 2 depicts the PGS 10 with the exterior housing 14 removed for purposes of exposing various internal features of the PGS 10. In FIGS. 3 and 4, certain additional internal features of the PGS 10 unrelated to the compressor vibration dampening system serving as the focal point of the subject disclosure are removed in comparison to FIG. 2, thus exposing a stand 16. As most readily apparent in FIG. 4, the compressor 12 is positioned upon the stand 16 which effectively elevates the compressor 12 to a location within the housing 14 which is well above any support surface upon which the PGS 10 may be rested when viewed for the perspective shown in FIG. 1. In more general terms, which are sufficient based on the intended emphasis of the present disclosure, the stand 16 comprises a primary support surface 18 which is elevated by four legs 20. These legs 20 are not identically configured, but rather are provided in one pair which are each of a first shape, and a second pair which are each of a second shape different from the first. The primary support surface 18 and the legs 20 collectively, partially define a void or open space which accommodates select internal components of the PGS 10, including a side-by-side pair of internal storage canisters 22. The stand 16 functions as a support modality which effectively positions the compressor 12 in a location within the interior of the housing 14 as allows to be operatively interfaced to other internal components of the PGS 10 in a manner minimizing spatial requirements, and thus optimizing spatial efficiency. Along these lines, as seen in and viewed from the perspective of FIG. 3, the compressor 12 and canisters 22 are located at respective ones of the opposite sides of the primary support surface 18, i.e., the compressor 12 above it and the canisters 22 below it.

The compressor 12 integrated into the PGS 10 is of the double acting variety. In other words, in general terms, it includes a pair unidirectional inlet check valves proximate respective ones of the opposed ends of a cylinder bore, and a reciprocating piston which is disposed within the cylinder bore and works in both directions, i.e., the intake stroke on one end becomes the compression stroke on the other, and vice versa. Along these lines, and with reference to FIG. 6, the compressor 12 includes a first air inlet 24 and a second air inlet 26, each of which is partially defined by a respective one of a pair of adapters 28 of the compressor 12. The first and second air inlets 24, 26 (including the corresponding adapters 28) each fluidly communicate with the interior of the cylinder bore (not shown) defined within the compressor 12 on opposite sides of the piston (also not shown) which is itself disposed within the cylinder bore. The inlet check valves of the compressor 12 mentioned above, though also not shown, are fluidly integrated into respective ones of the first and second air inlets 24, 26 between the cylinder bore and respective ones of the adapters 28.

The compressor 12 also includes a pair of unidirectional outlet check valves (also not shown) which are likewise proximate respective ones of the opposed ends of the cylinder bore. These outlet check valves are integrated into respective ones of first and second air outlets which, like the first and second air inlets 24, 26, each fluidly communicate with the interior of the cylinder bore on opposite sides of the piston. The first and second air outlets also fluidly communicate with a common air outlet 30 of the compressor 12.

During operation of the compressor 12, any intake stroke of the piston draws air through one of the first and second air inlets 24, 26 (including a corresponding one of the integrated inlet check valves) and into a portion of the cylinder bore. Any compression stroke of the piston forces air from a portion of the cylinder bore through one of the first and second air outlets (including a corresponding one of the integrated outlet check valves) and thereafter through the common air outlet 30. As will be recognized, the reciprocating movement of the piston, and the functional actions of the inlet and outlet check valves, impart vibrations to the compressor 12 which, as previously described, may facilitate the generation of unwanted noise if not properly dampened.

Referring now to FIGS. 3-8, another internal component of the PGS 10 is a support plate assembly 32 which is disposed within the housing 14 and used to operatively interface the compressor 12 to the underlying primary support surface 18 of the stand 16. As most easily seen in FIGS. 5-8 and as viewed from the perspective shown therein, the support plate assembly 32 comprises an elongate support plate 34 defining a first (top) surface 36 and an opposed, second (bottom) surface 38. The second surface 38 is defined by a portion of the support plate 34 which is sized and configured to be advanced into a complimentary recess disposed within the primary support surface 18 as facilitates the operative interface of the support plate assembly 32 to the stand 16. The support plate 34 also defines four (4) outwardly projecting, generally cylindrical attachment lugs 40. The lugs 40 are arranged in a generally rectangular pattern, with opposed pairs thereof being located proximate respective one of the opposed end portions of the support plate 34. Each of the lugs 40 also projects outwardly from and is integrally connected to a corresponding triangular extension of the support plate 34, such extensions effectively orienting the lugs 40 above the first surface 36. The opposed end portions of the support plate 34 are each partially defined by a respective arcuately contoured, convex outer surface portion 42. Overhanging at least a segment of each such outer surface portion 42 is a corresponding retention plate 44. As most easily seen in FIGS. 5 and 6, that surface of each retention plate 44 which extends to a corresponding outer surface portion 42 at approximately a ninety-degree angle is substantially coplanar with the first surface 36 of the support plate 34. The functionality of the lugs 40, outer surface portions 42 and retention plates 44 in the context of the compressor dampening system will be described in more detail below.

In the compressor dampening system of the present disclosure, one of the primary structural features thereof is a pair of resilient first and second bellows 46, 48 which are identically configured to each other. Each of the first and second bellows 46, 48 is operatively interposed between the compressor 12 and the first surface 36 of the underlying support plate 34, and hence the primary support surface 18 of the stand 16. As will be described below, the first and second bellows 46, 48 are adapted, and hence operative, to dampen movement of the compressor 12 along multiple axes.

In greater detail, it is contemplated that each of the first and second bellows 46, 48 may be included as part of the support plate assembly 32, and thus cooperatively engaged to the support plate 34. It is further contemplated that, along with the above-described adapters 28, the first and second bellows 46, 48 will also each at least partially define respective ones of the first and second air inlets 24, 26 of the compressor 12. Along these lines, the size and shape of each of first and second bellows 46, 48, and the way they are cooperatively engaged to the support plate 34, is such that each of a respective one of the first and second air inlets 24, 26 partially defined thereby extends between the first and second surfaces 36, 38 of the support plate 34. Those ends of the first and second bellows 46, 48 terminating proximate the second surface 38 are intended to fluidly communicate with ambient air. From the perspectives shown in FIGS. 5-8, such size and shape, and manner of cooperative engagement to the support plate 34, also results in the first and second bellows 46, 48 each protruding upwardly from the first surface 36 of the support plate 34 such that the distal end thereof is spaced from the first surface 36 by a prescribed distance which exceeds the length of each of the identically configured adapters 28. In this regard, in the PGS 10, the use of the support plate assembly 32 to operatively interface the compressor 12 to the stand 16 entails fluidly coupling the compressor 12 to the first and second bellows 46, 48 by advancing the adapters 28 into the distal ends of respective ones of the first and second bellows 46, 48. Based on the lengths of the adapters 28 relative to the protrusion distance of the first and second bellows 46, 48 from the first surface 36, the adapters 28 terminate short of the first surface 36 even after being fully advanced into respective one of the first and second bellows 46, 48 and frictionally retained therein.

With the adapters 28 being advanced and frictionally retained within respective ones of the first and second bellows, 46, 48, the first and second air inlets 24, 26 of the compressor 12 are partially defined by the first and second bellows 46, 48 as indicated above. As also indicated above, each of the first and second bellows 46, 48 is operatively interposed between the compressor 12 and the first surface 36 of the support plate 34, meaning that, as viewed from the perspectives shown in FIGS. 5-8, they are located beneath the compressor 12 and effectively sandwiched between it and the underlying support plate 34. This orientation of the first and second bellows 46, 48 accomplishes several important objectives in the context of the construction of the PGS 10. One is that each of the first and second bellows 46, 48 can provide dual-purpose functionality, i.e., the ability to provide effective vibration dampening for the compressor 12 during its operation in the context of the compressor dampening system of the present disclosure, while simultaneously partially defining requisite air inlet flow paths to the compressor 12. This dual-purpose functionality, coupled with the location of the first and second bellows 46, 48 between the compressor 12 and support plate 34, further minimizes spatial requirements, thereby achieving spatial economies which promote making the PGS 10 as small and lightweight as possible.

The first and second bellows 46, 48 are each sized and configured such that the vibration dampening capability provided thereby is along multiple axes as indicated above. When viewed from the perspectives shown in FIGS. 5-8, these include the dampening of any vertical movement, horizontal movement, or angular movement (resulting from any pivoting or rotation) of the compressor 12 relative to the support plate 34. Along these lines, the first and second bellows 46, 48 are each preferably fabricated from a material selected to be of a Shore hardness which is operative to maintain the patency of respective ones of the first and second air inlets 24, 26 partially defined thereby, while concurrently dampening movement/vibration of the compressor 12.

In addition to the first and second bellows 46, 48, the compressor dampening system may comprise resilient, loop-shaped first and second side bands 50, 52 which are cooperatively engaged to and extend between the compressor 12 and the support plate 34 of the support plate assembly 32. As will be described below, like the first and second bellows 46, 48, each of the first and second side bands 50, 52 is adapted, and hence operative, to dampen movement of the compressor along multiple axes.

Figure 8:
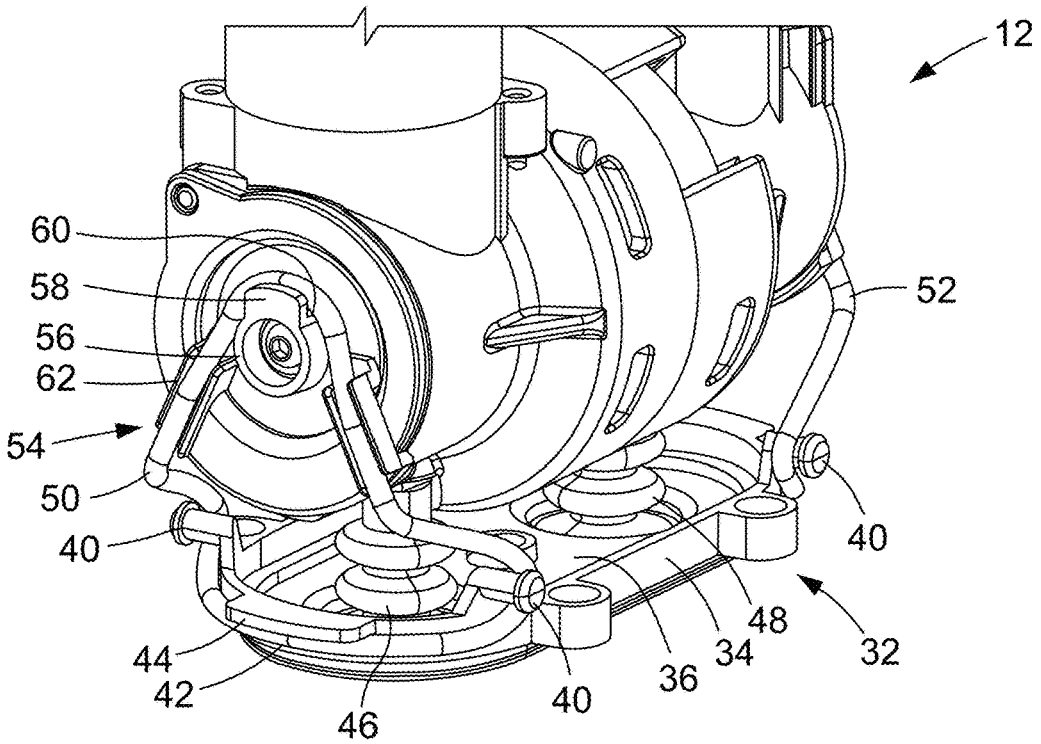
FIG. 8 is an end perspective view of the compressor as engaged to the support plate assembly, depicting the engagement pattern of one of the side bands of FIG. 7 to both the compressor and support plate assembly.

In greater detail, it is contemplated that each of the opposed ends of the compressor 12 will be outfitted with a respective one of an identically configured pair of band plates 54. As best seen in FIG. 8, each of the band plates 54 defines a generally cylindrical central hub 56, a portion of which includes a retention tab 58 protruding radially therefrom. The retention tab 58 defines an arcuate retention surface 60, portions of which extend at approximately a ninety-degree angle relative to each other. Each band plate 54 further defines a spaced pair of elongate retention troughs 62 which each extend angularly relative to the corresponding retention surface 60.

The cooperative engagement of each of the first and second side bands 50, 52 to both the compressor 12 and support plate 34 occurs in the same manner and will be described below in terms of the first side band 50, such description thus being likewise applicable to the second side band 52. In this regard, the first side band 50 is placed upon the retention surface 60 of the retention tab 58 and extended through each of the retention troughs 62. Thereafter, the first side band 50 is partially wrapped about an inwardly directed surface of each of the lugs 40 of a corresponding pair thereof which is proximate one of the opposed end portions of the support plate 34. Finally, the first side band 50 is placed upon and extended over a corresponding outer surface portion 42 and maintained in an operative position thereon by its abutment against the corresponding retention plate 44. Thus, in a preferred implementation, the first side band 50 is cooperatively engaged to the support plate 34 at each of three separate contact points defined by the corresponding pair of lugs 40 and outer surface portion 42. The sizing of the first side band 50 is selected so that it is stretched (and thus under tension) when it assumes the serpentine configuration shown in FIG. 8 resulting from it being advanced around the corresponding band plate 54, lugs 40 and outer surface portion 42 in the above-described manner.

The first and second side bands 50, 52 are also configured such that the vibration dampening capability provided thereby is along multiple axes as indicated above. When viewed from the perspectives shown in FIGS. 7-8, these include the dampening of any vertical movement, horizontal movement, or angular movement (resulting from any pivoting or rotation) of the compressor 12 relative to the support plate 34. However, it will be recognized that the dominant dampening functionality provided by the first and second side bands 50, 52 is in relation to side-to-side movement of the compressor 12 along an axis which is generally parallel to the longitudinal axis of the support plate 34 (the first and second bellows 46, 48 preferably being positioned along this longitudinal axis).

Referring now to FIGS. 2, 4, 9 and 10, the compressor dampening system may further comprise a resilient discharge tube 64, one end of which is operatively coupled to the air outlet 30 of the compressor 12 to effectively establish fluid communication between the discharge tube 64 and the compressor 12. Like the first and second bellows 46, 48 and first and second side bands 50, 52, the discharge tube 64 is adapted, and hence operative, to dampen movement of the compressor 12 along multiple axes.

In the PGS 10, the discharge tube 64, like the first and second bellows 46, 48, has dual-purpose functionality in the context of the compressor dampening system. Along these lines, the orientation of the discharge tube 64 within the PGS 10 allows the discharge tube 64 to provide effective vibration dampening for the compressor 12 during its operation, while simultaneously defining a requisite air outlet flow path from the compressor 12. This dual-purpose functionality reduces the need for additional compressor dampening modalities within the PGS 10, thus supporting the objective of allowing the PGS 10 to be made as small and lightweight as possible.

The discharge tube 64 is sized and configured such that the vibration dampening capability provided thereby is along multiple axes as indicated above. When viewed from the perspective shown in FIG. 4, these include the dampening of any vertical movement, horizontal movement, or angular movement (resulting from any pivoting or rotation) of the compressor 12 relative to the support plate 34. However, it will be recognized that the dominant dampening functionality provided by the discharge tube 64 is in relation to vertical movement of the compressor 12 along an axis which is normal to the first surface 36 of the support plate 34. Along these lines, the discharge tube 64 is preferably fabricated from a material selected to be of a Shore hardness which is operative to maintain the patency of the patency of an airflow path defined thereby, while concurrently dampening movement/vibration of the compressor 12.

Figure 9:
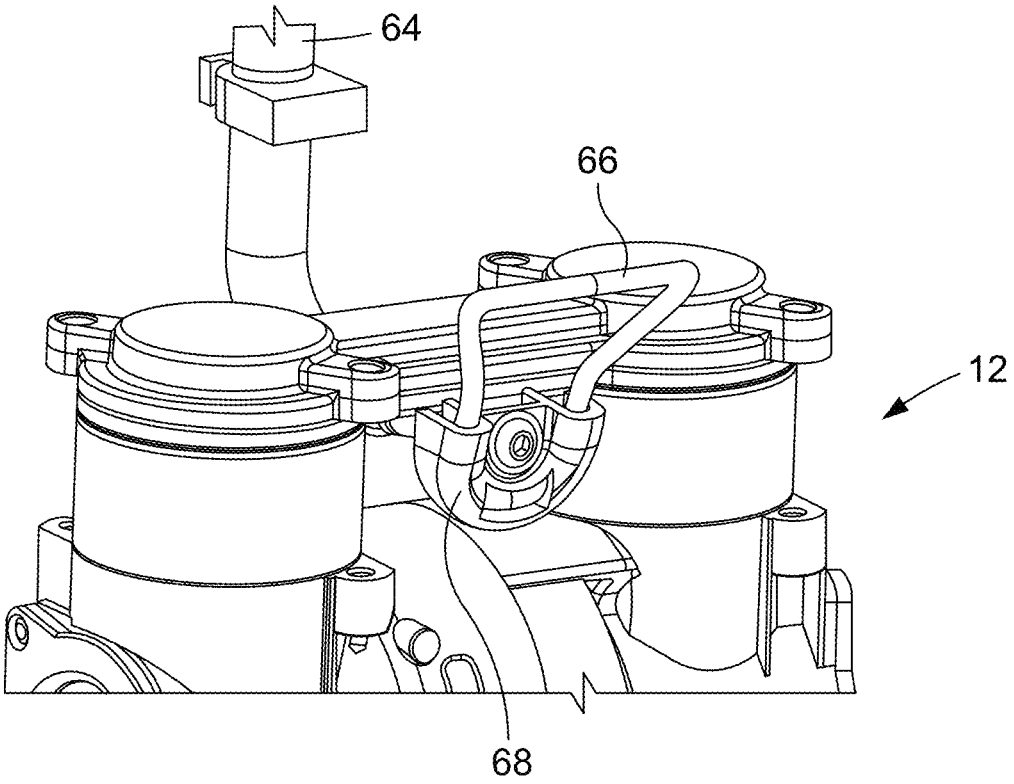
FIG. 9 is a partial, top perspective view of the compressor depicting a suspension band and a portion of a multi-function discharge tube which are each parts of the present dampening system.
Figure 10:
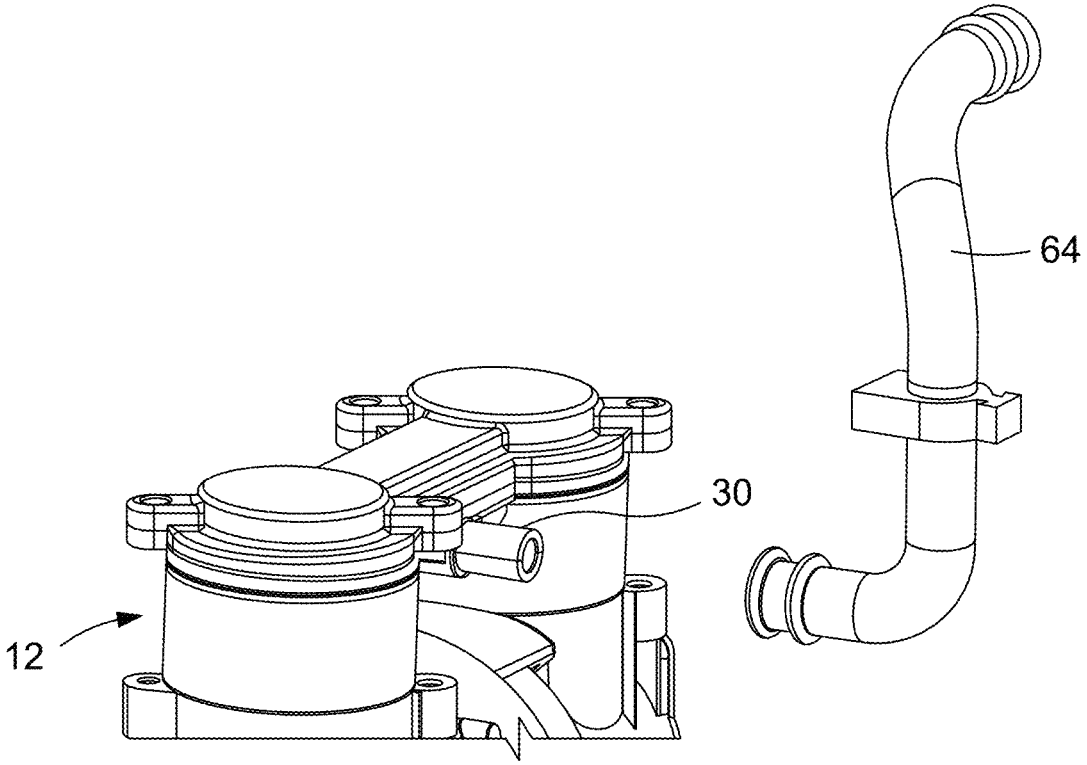
FIG. 10 is an exploded view of the compressor and discharge tube shown in FIG. 9.

Referring now to FIGS. 4 and 9, still further, the compressor dampening system may comprise a resilient, loop-shaped suspension band 66 which is cooperatively engaged to and extends between the compressor 12 and some other structural feature of the PGS 10 within or defined by the exterior housing 14. Like those other structural features of the compressor dampening system described above, the suspension band 66 is adapted, and hence operative, to dampen movement of the compressor 12 along multiple axes.

In the PGS 10, a portion of the suspension band 66 is operatively captured within a generally U-shaped retention sleeve 68 which is secured to the compressor 12. The exposed portion of the suspension band 66 is adapted to be secured to or suspended from another structural feature disposed within or defined by the housing 14 as indicated above, such that the suspension band 66 is at least slightly stretched, and thus under tension.

The suspension band 66 is sized and configured such that the vibration dampening capability provided thereby is along multiple axes as also indicated above. When viewed from the perspective shown in FIG. 9, these include the dampening of any vertical movement, horizontal movement, or angular movement (resulting from any pivoting or rotation) of the compressor 12 relative to the support plate 34. However, it will be recognized that the dominant dampening functionality provided by the suspension band 66 is like that provided by the discharge tube 64, i.e., in relation to vertical movement of the compressor 12 along an axis which is normal to the first surface 36 of the support plate 34. In a preferred implementation, the suspension band 66 and the discharge tube 64 are cooperatively engaged to the compressor 12 in generally opposed relation to each other.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A portable gas source (PGS) comprising:

a housing;

a compressor disposed within the housing, the compressor including a first air inlet, a second air inlet, and an air outlet; and a compressor dampening system, comprising:

a resilient first bellows operatively interposed between the compressor and the housing and adapted to dampen movement of the compressor along multiple axes, the first bellows at least partially defining the first air inlet and fluidly communicating with ambient air;

a resilient second bellows operatively interposed between the compressor and the housing and adapted to dampen movement of the compressor along multiple axes, the second bellows at least partially defining the second air inlet and fluidly communicating with ambient air; and a resilient discharge tube operatively coupled to and fluidly communicating with the air outlet, the discharge tube being adapted to dampen movement of the compressor along multiple axes.

2. The PGS of claim 1 wherein the dampening system further comprises resilient first and second side bands cooperatively engaged to and extending between the compressor and the housing in opposed relation to each other, each of the first and second side bands being adapted to dampen movement of the compressor along multiple axes.

3. The PGS of claim 2 wherein the dampening system further comprises a resilient suspension band cooperatively engaged to and extending between the compressor and the housing, the suspension band being adapted to dampen movement of the compressor along multiple axes.

4. The PGS of claim 3 wherein the suspension band and the discharge tube are cooperatively engaged to the compressor in generally opposed relation to each other.

5. The PGS of claim 2 further comprising a support plate disposed within the housing underneath the compressor, the first and second bellows and the first and second side bands each being cooperatively engaged to and extending between the support plate and the compressor, with the first and second bellows each underlying the compressor.

6. The PGS of claim 5 further comprising a stand disposed within the housing, the support plate operatively interfacing the compressor to the stand.

7. The PGS of claim 5 wherein each of the first and second side bands is cooperatively engaged to the support plate at each of three separate contact points.

8. The PGS of claim 1 wherein each of the first and second bellows and the discharge tube is fabricated from a material selected to be of a Shore hardness which is operative to maintain the patency of a respective airflow path defined thereby while concurrently dampening movement of the compressor.

9. A portable gas source (PGS) comprising:

a housing;

a support plate disposed within the housing;

a compressor disposed within the housing above the support plate, the compressor including a first air inlet, a second air inlet, and an air outlet;

a compressor dampening system, comprising:

a resilient first bellows cooperatively engaged to the support plate and operatively interposed between the compressor and the support plate to dampen movement of the compressor along multiple axes, the first bellows at least partially defining the first air inlet and fluidly communicating with ambient air;

a resilient second bellows cooperatively engaged to the support plate and operatively interposed between the compressor and the support plate to dampen movement of the compressor along multiple axes, the second bellows at least partially defining the second air inlet and fluidly communicating with ambient air;

a resilient discharge tube in fluid communication with the air outlet and operative to dampen movement of the compressor along multiple axes;

resilient first and second side bands cooperatively engaged to and extending between the compressor and the support plate in opposed relation to each other, each of the first and second side bands being operative to dampen movement of the compressor along multiple axes; and a resilient suspension band cooperatively engaged to and extending between the compressor and the housing, the suspension band being operative to dampen movement of the compressor along multiple axes.

10. The PGS of claim 9 wherein the suspension band and the discharge tube are cooperatively engaged to the compressor in generally opposed relation to each other.

11. The PGS of claim 9 further comprising a stand disposed within the housing, the support plate operatively interfacing the compressor to the stand.

12. The PGS of claim 9 wherein each of the first and second side bands is cooperatively engaged to the support plate at each of three separate contact points.

13. The PGS of claim 9 wherein each of the first and second bellows and the discharge tube is fabricated from a material selected to be of a Shore hardness which is operative to maintain the patency of a respective airflow path defined thereby while concurrently dampening movement of the compressor.

14. A portable gas source (PGS) comprising:

a housing;

a compressor disposed within the housing, the compressor including a first air inlet, a second air inlet, and an air outlet; and a compressor dampening system, comprising:

a resilient first bellows operatively interposed between the compressor and the housing and adapted to dampen movement of the compressor along multiple axes, the first bellows at least partially defining the first air inlet and fluidly communicating with ambient air;

a resilient second bellows operatively interposed between the compressor and the housing and adapted to dampen movement of the compressor along multiple axes, the second bellows at least partially defining the second air inlet and fluidly communicating with ambient air; and resilient first and second side bands cooperatively engaged to and extending between the compressor and the housing in opposed relation to each other, each of the first and second side bands being adapted to dampen movement of the compressor along multiple axes.

15. The PGS of claim 14 further comprising a support plate disposed within the housing underneath the compressor, the first and second bellows and the first and second side bands each being cooperatively engaged to and extending between the support plate and the compressor, with the first and second bellows each underlying the compressor.

16. The PGS of claim 15 wherein each of the first and second side bands is cooperatively engaged to the support plate at each of three separate contact points.

17. The PGS of claim 15 further comprising a stand disposed within the housing, the support plate operatively interfacing the compressor to the stand.

18. The PGS of claim 14 wherein the dampening system further comprises a resilient suspension band cooperatively engaged to and extending between the compressor and the housing, the suspension band being adapted to dampen movement of the compressor along multiple axes.

19. The PGS of claim 14 further comprising a resilient discharge tube operatively coupled to and fluidly communicating with the air outlet, the discharge tube being adapted to dampen movement of the compressor along multiple axes.

20. The PGS of claim 19 wherein each of the first and second bellows and the discharge tube is fabricated from a material selected to be of a Shore hardness which is operative to maintain the patency of a respective airflow path defined thereby while concurrently dampening movement of the compressor.

* * * * *